US012085327B2

(12) United States Patent
Tsukui et al.

(10) Patent No.: US 12,085,327 B2
(45) Date of Patent: Sep. 10, 2024

(54) COLD STORAGE

(71) Applicant: PHC Corporation, Ehime (JP)

(72) Inventors: Nobuyuki Tsukui, Gunma (JP); Eiichi Mori, Ehime (JP); Eiji Doi, Ehime (JP)

(73) Assignee: PHC CORPORATION, Ehime (JP)

( * ) Notice: Subject to any disclaimer, the term of this patent is extended or adjusted under 35 U.S.C. 154(b) by 262 days.

(21) Appl. No.: 17/674,159

(22) Filed: Feb. 17, 2022

(65) Prior Publication Data

US 2022/0170687 A1 Jun. 2, 2022

Related U.S. Application Data

(63) Continuation of application No. PCT/JP2020/030917, filed on Aug. 14, 2020.

(30) Foreign Application Priority Data

Aug. 28, 2019 (JP) ..... 2019-155915

(51) Int. Cl.
*F25D 17/06* (2006.01)
*F25D 23/02* (2006.01)
*F25D 29/00* (2006.01)

(52) U.S. Cl.
CPC ..... *F25D 17/06* (2013.01); *F25D 23/021* (2013.01); *F25D 29/00* (2013.01); *F25D 2317/0651* (2013.01); *F25D 2321/142* (2013.01); *F25D 2400/36* (2013.01); *F25D 2700/12* (2013.01)

(58) Field of Classification Search
CPC ..... F25D 29/005; F25D 2323/00274; F25D 2323/00263; F25D 2323/00261; F25D 2700/12; F25D 2321/142; F25D 2317/0651; F25D 23/021; F25D 17/06
See application file for complete search history.

(56) References Cited

FOREIGN PATENT DOCUMENTS

| | | | | |
|---|---|---|---|---|
| JP | H09-236374 | A | | 9/1997 |
| JP | 2000-088438 | A | | 3/2000 |
| JP | 2001-221548 | A | | 8/2001 |
| JP | 2001245759 | A | * | 9/2001 |
| JP | 2004-251581 | A | | 9/2004 |
| JP | 2006-010138 | A | | 1/2006 |
| JP | 2009-198058 | A | | 9/2009 |

(Continued)

OTHER PUBLICATIONS

JP-2001245759-A Translation (Year: 2001).*

(Continued)

*Primary Examiner* — Schyler S Sanks
(74) *Attorney, Agent, or Firm* — Rimon P.C.

(57) ABSTRACT

This cold storage is provided with: a first sliding door that opens/closes a cold chamber; a second sliding door that opens/closes the cold chamber, and is positioned between the cold chamber and the first sliding door when the cold chamber is fully open; a compressor disposed at a position that becomes closer to the closed end of the second sliding door than the closed end of the first sliding door when the cold chamber is fully closed; a fan that generates air flow passing the surroundings of the compressor; and a housing that accommodates the compressor, and has formed therein a blow port for blowing out the air flow toward the first sliding door and the second sliding door.

8 Claims, 3 Drawing Sheets

(56) References Cited

FOREIGN PATENT DOCUMENTS

JP 2016-109385 A 6/2016

OTHER PUBLICATIONS

International Search Report and Written Opinion issued in International Patent Application No. PCT/JP2020/030917, dated Oct. 20, 2020; with partial English translation.
Extended European Search Report issued in corresponding European Patent Application No. 20855864.3, dated Dec. 12, 2022.

* cited by examiner

COLD STORAGE

CROSS-REFERENCE OF RELATED APPLICATIONS

This application is a Continuation of International Patent Application No. PCT/JP2020/030917, filed on Aug. 14, 2020, which in turn claims the benefit of Japanese Application No. 2019-155915, filed on Aug. 28, 2019, the entire disclosures of which Applications are incorporated by reference herein.

TECHNICAL FIELD

The present disclosure relates to a refrigerator including a sliding door.

BACKGROUND ART

When a refrigeration compartment is cooled in a cooling storage for storing an object under a low temperature environment, the inner surface of the door for opening and closing the refrigeration compartment is also cooled. The outer surface of the door is also cooled depending on the case. In this case, the moisture in the outside air, i.e., the air surrounding the outer surface of the door may condense, and cause condensation on the outer surface of the door.

PTL 1 discloses a cooling storage that supplies, to the outer surface of the glass door, the relatively warm air in a machine compartment located on the lower side of the storage compartment for the purpose of preventing the condensation at the outer surface of the glass door.

CITATION LIST

Patent Literature

PTL 1
Japanese Patent Application Laid-Open No. 2000-88438

SUMMARY OF INVENTION

Technical Problem

However, in a refrigerator including a plurality of sliding doors, only supplying the air of the cooling storage compartment to the sliding door cannot sufficiently suppress the generation of condensation at the sliding door.

An object of the present disclosure is to provide a refrigerator in which the generation of condensation at a sliding door is suppressed.

Solution to Problem

A refrigerator according to the present disclosure includes: a first sliding door configured to open and close a refrigeration compartment; a second sliding door configured to open and close the refrigeration compartment, the second sliding door being located between the refrigeration compartment and the first sliding door when the refrigeration compartment is in a fully opened state; a compressor disposed at a position closer to a closing end of the second sliding door than a closing end of the first sliding door when the refrigeration compartment is in the fully closed state; a fan configured to generate an airflow that passes through a periphery of the compressor; a housing in which an air blow port is formed, the housing being configured to house the compressor, the air blow port being configured to blow out the airflow toward the first sliding door and the second sliding door; and a recorder attaching part disposed inside the housing at a position closer to the closing end of the first sliding door than the closing end of the second sliding door. The first sliding door and the second sliding door are located on a front surface side of the housing. The housing includes a front surface panel configured to cover the inside from the front surface side. The recorder attaching part is located at a surface of the front surface panel on the inside, and on a lower side of the air blow port.

Advantageous Effects of Invention

The present disclosure can provide a refrigerator in which the generation of condensation at a sliding door is suppressed.

DESCRIPTION OF EMBODIMENTS

An embodiment of the present disclosure is elaborated below with reference to the accompanying drawings. Note that the embodiment described below is merely an example, and the present disclosure is not limited to the embodiment.

Figure 1:
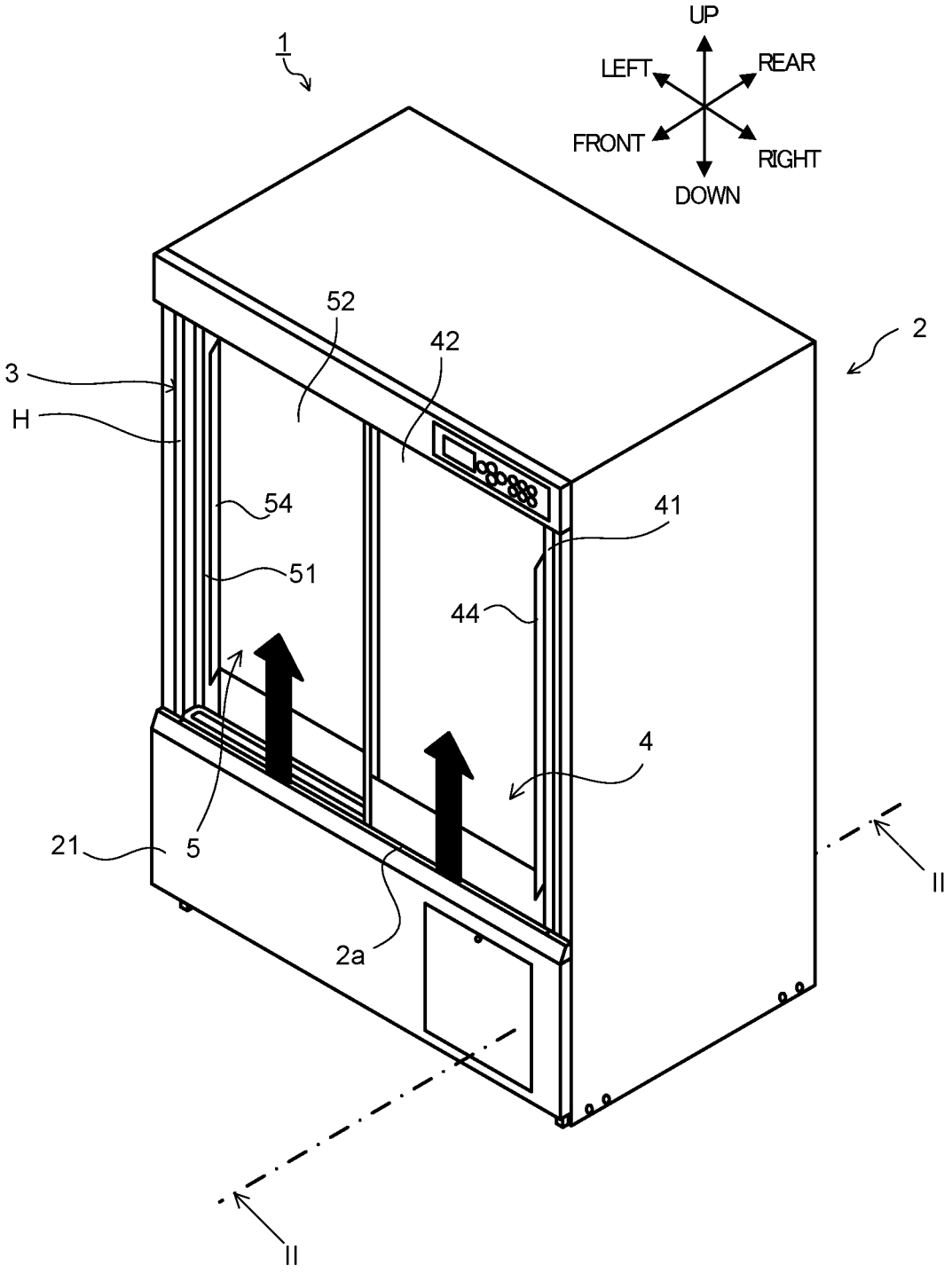
FIG. 1 is a perspective view of a refrigerator according to the present disclosure.
Figure 2:
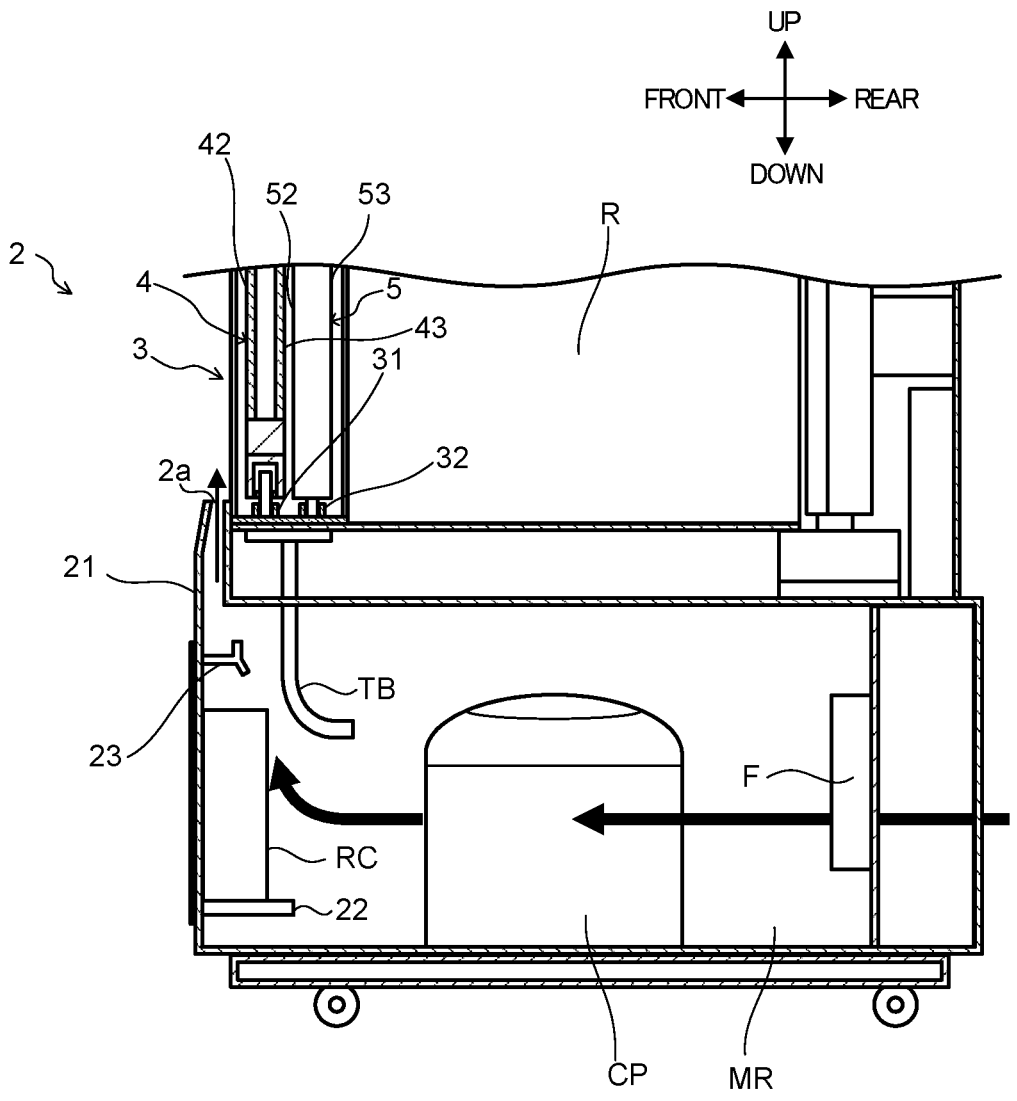
FIG. 2 is a II-II cross-sectional view of FIG. 1.
Figure 3:
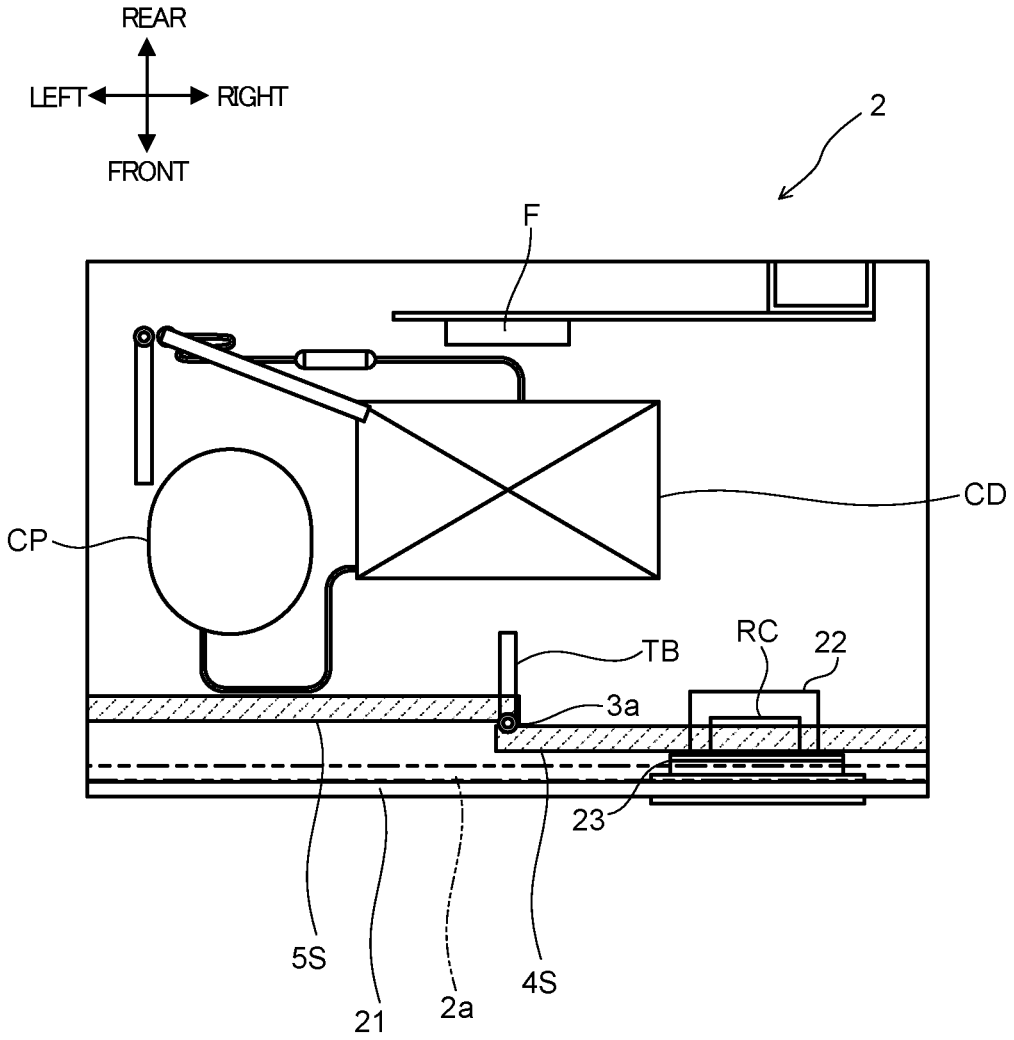
FIG. 3 is a schematic plan view illustrating an arrangement of apparatuses in a machine compartment of a housing of the refrigerator of the present disclosure.

First, a configuration of refrigerator 1 is described with reference to FIGS. 1, 2, and 3. FIG. 1 is a perspective view of refrigerator 1 according to the present disclosure. FIG. 1 illustrates a state where outer sliding door 4 and inner sliding door 5 described later are at a fully closed position. FIG. 2 is a cross-sectional view taken along II-II of FIG. 1. Note that in FIG. 2, the illustration of condenser CD is omitted. FIG. 3 is a schematic plan view illustrating an arrangement of apparatuses in machine compartment MR provided in refrigerator 1 of the present disclosure. Note that refrigerator 1 of the present embodiment is, for example, a medicine refrigerator for storing pharmaceutical drugs. In addition, in the present specification, the front side of refrigerator 1 is the side facing the user using it (the side on which outer sliding door 4 and inner sliding door 5 are provided), and the side opposite to the front side is the rear side of refrigerator 1. In addition, the left side and the right side as viewed from the front side are the left side and the right side of refrigerator 1.

Refrigerator 1 includes housing 2, frame body 3, outer sliding door (first sliding door) 4, and inner sliding door (second sliding door) 5.

Opening H is formed in the front surface of housing 2. Although not illustrated in the drawing, a heat insulation material is provided between the outer peripheral surface and the inner peripheral surface of housing 2. The space surrounded by the inner peripheral surface of housing 2 is refrigeration compartment R, which is a space for housing an object (see FIG. 2). In addition, the internal space on the lower side of refrigeration compartment R is machine compartment MR. Refrigeration compartment R and machine compartment MR are parted, and ventilation between refrigeration compartment R and machine compartment MR is not allowed. Note that housing 2 and machine compartment MR are elaborated later.

Frame body 3 is provided in housing 2 to surround opening H. In frame body 3, outer lane 31 and inner lane 32 are formed (see FIG. 2). In frame body 3, outer lane 31 is located on the front side than inner lane 32.

In frame body 3, guiding hole 3*a* for guiding condensation water generated at outer sliding door 4, inner sliding door 5 or frame body 3 to machine compartment MR is formed (see FIG. 3). Guiding hole 3*a* is provided at a center portion of the lower frame part of frame body 3 as viewed from the front. Condensation water past guiding hole 3*a* flows into machine compartment MR through pipe TB described later.

As illustrated in FIG. 2, outer sliding door 4 is disposed on outer lane 31, and inner sliding door 5 is disposed on inner lane 32. Outer sliding door 4 opens and closes refrigeration compartment R by moving in the horizontal direction on outer lane 31. Inner sliding door 5 opens and closes refrigeration compartment R by moving in the horizontal direction on inner lane 32. Inner sliding door 5 is located between refrigeration compartment R and outer sliding door 4 when refrigeration compartment R is in the fully opened state. Note that the opening direction and the closing direction of outer sliding door 4 correspond to the left direction and the right direction, respectively, and the opening direction and the closing direction of inner sliding door 5 correspond to the right direction and the left direction, respectively.

Outer sliding door 4 and inner sliding door 5 are doors including a glass layer. 41 and 51 in FIG. 1 are the closing end of outer sliding door 4 and the closing end of inner sliding door 5, respectively. Closing end 41 and closing end 51 are end parts on the closing direction side of the sash of outer sliding door 4 and inner sliding door 5, respectively.

42 and 43 in FIG. 2 are the outer surface and the inner surface of outer sliding door 4, respectively. Outer surface 42 is the surface on the outer side (forward side) of refrigeration compartment R, and inner surface 43 is the surface on the refrigeration compartment R side (rear side). Likewise, 52 and 53 in FIG. 2 are the outer surface and the inner surface of inner sliding door 5. Outer surface 52 is the surface on the outer side (forward side) of refrigeration compartment R, and inner surface 53 is the surface on the refrigeration compartment R side (rear side).

Note that 44 and 54 in FIG. 1 are handles provided at outer sliding door 4 and inner sliding door 5, respectively. When opening or closing outer sliding door 4 and inner sliding door 5, the user grabs handle 44 and handle 54, respectively.

As illustrated in FIGS. 2 and 3, housing 2 includes front surface panel 21, recorder attaching part 22, and eaves 23.

Front surface panel 21 covers the front side of machine compartment MR (see FIG. 2). Recorder RC described later is attached to recorder attaching part 22. Recorder attaching part 22 is located on the right side of the surface of front surface panel 21 on machine compartment MR side.

Note that 4S in FIG. 3 is an orthogonal projection of outer sliding door 4 to the bottom surface of housing 2, and SS is an orthogonal projection of inner sliding door 5 to the bottom surface of housing 2. In addition, the range indicated by the chain double-dashed line in FIG. 3 represents the range of an orthogonal projection of air blow port 2*a* to the bottom surface. As can be seen from FIG. 3, recorder attaching part 22 is disposed inside housing 2 at a position closer to closing end 41 of outer sliding door 4 in the fully closed state than closing end 51 of inner sliding door 5 in the fully closed state.

Eaves 23 is a component that covers recorder RC attached to recorder attaching part 22, from above. Eaves 23 is attached to the surface of front surface panel 21 on machine compartment MR side, and is located on the upper side of recorder attaching part 22.

In housing 2, air blow port 2*a* facing upward is formed in front of frame body 3. Air blow port 2*a* is a hole that blows out the airflow inside machine compartment MR toward outer sliding door 4 and inner sliding door 5. FIG. 1 illustrates a state where air blow port 2*a* as a single hole is formed from closing end 41 of outer sliding door 4 in the fully closed state to closing end 51 of inner sliding door 5 in the fully closed state. Note that a plurality of holes may be formed as air blow port 2*a*.

Housing 2 houses in its inside compressor CP, condenser CD, fan F, recorder RC, and pipe TB. In other words, compressor CP, condenser CD, fan F, recorder RC, and pipe TB are disposed inside machine compartment MR.

Compressor CP and condenser CD make up a refrigeration circuit for cooling the inside of refrigeration compartment R. Compressor CP and condenser CD emit heat during operation, and therefore the air surrounding compressor CP and condenser CD is heated.

Compressor CP is disposed on the left side in machine compartment MR. Specifically, compressor CP is disposed at a position closer to closing end 51 of inner sliding door 5 in the fully closed state than closing end 41 of outer sliding door 4 in the fully closed state. Condenser CD is disposed at a center portion in the horizontal direction inside housing 2. Condenser CD, as with compressor CP, is disposed at a position closer to closing end 51 of inner sliding door 5 in the fully closed state than closing end 41 of outer sliding door 4 in the fully closed state.

For example, fan F takes in the air outside refrigerator 1 from the intake port (not illustrated in the drawing) formed on the rear side of housing 2, and sends the taken air toward condenser CD to cool condenser CD. Fan F generates not only the airflow that passes through the periphery of condenser CD, but also the airflow that passes through the periphery of compressor CP. FIG. 2 illustrates an airflow generated by fan F.

The airflow generated by fan F is output from air blow port 2*a* toward outer surface 42 of outer sliding door 4 and outer surface 52 of inner sliding door 5.

Recorder RC is an apparatus that records the temperature of refrigeration compartment R. When a measurement result of the temperature sensor (not illustrated in the drawing) that measures the temperature inside refrigeration compartment R is input to recorder RC, recorder RC prints the measurement result on a recording sheet and outputs it to the outside of refrigerator 1. Recorder RC is housed in housing 2, and is attached to recorder attaching part 22. Note that recorder RC is manufactured separately from refrigerator 1, and is housed into housing 2 from the door of front surface panel 21 after refrigerator 1 is manufactured. In addition, recorder RC may be attached in place of the door of front surface panel 21, and the upper side of recorder RC is covered with eaves 23. While eaves 23 is provided on machine compartment MR side of front surface panel 21, it may be provided, on the upper side of recorder RC, integrally with recorder RC to be replaced. Note that eaves 23 has a shape that guides, toward air blow port 2*a*, the airflow generated by fan F. For example, as illustrated in FIG. 2, eaves 23 may have a shape with a first flat plate part, a second flat plate part, and a wall part. The first flat plate part extends in a direction away from front surface panel 21 from the inner surface of front surface panel 21. The second flat plate part extends downward in the direction away from front surface panel 21 from the end part of the first flat plate part on the side opposite to front surface panel 21, and extends from the left end to the right end of the first flat plate part. The wall part protrudes upward from the end part and extends from the left end to the right end of the first flat plate part. In addition, while eaves 23 covers the portion on front surface panel 21 side of recorder RC and recorder attaching part 22 in FIG. 3, it may cover the entire range on the upper side of recorder attaching part 22 and recorder RC.

Pipe TB is located from the lower portion of the frame body 3 to the front of condenser CD. Pipe TB guides condensation water coming through guiding hole 3*a* of frame body 3, to the vicinity of condenser CD. The condensation water guided to the vicinity of condenser CD flows to a receiving pan not illustrated in the drawing. The condensation water that flows into the receiving pan is evaporated by the heat generated by condenser CD.

Next, operational effects of the present embodiment are described.

According to the present embodiment, relatively warm air inside machine compartment MR is supplied to outer surface 42 of outer sliding door 4 and outer surface 52 of inner sliding door 5 through air blow port 2*a*, and thus the generation of condensation at outer surface 42 and outer surface 52 can be suppressed. In addition, in the present embodiment, compressor CP as a heat source is disposed inside machine compartment MR of housing 2 at a position closer to closing end 51 of inner sliding door 5 in the fully closed state than closing end 41 of outer sliding door 4 in the fully closed state. In this manner, air warmer than the air supplied to outer sliding door 4 is easily supplied to inner sliding door 5. Thus, the effect of preventing the condensation at inner sliding door 5 provided at a position farther from air blow port 2*a* than outer sliding door 4 can be increased.

In addition, recorder RC, which is not a heat source, is disposed inside machine compartment MR of housing 2 at a position closer to closing end 41 of outer sliding door 4 in the fully closed state than closing end 51 of inner sliding door 5 in the fully closed state. In this manner, the air passing through the periphery of compressor CP toward inner sliding door 5 is less blocked. Specifically, the air warmed at the compressor CP is smoothly supplied toward outer surface 52 of inner sliding door 5 through air blow port 2*a*. Thus, the generation of condensation at outer surface 52 of inner sliding door 5 can be suppressed.

In addition, in the present embodiment, eaves 23 that covers the upper side of recorder attaching part 22 is provided on the upper side of recorder attaching part 22. Thus, even if foreign matters such as condensation water fall into machine compartment MR through air blow port 2*a* facing upward, recording sheets and recorder RC attached to recorder attaching part 22 can be protected. Note that eaves 23, with the configuration of covering the portion on front surface panel 21 side of recorder RC and recorder attaching part 22, can prevent the foreign matters such as condensation water falling through air blow port 2*a* from flowing into recorder RC along the first flat plate part by the wall part that protrudes upward from the end part of the first flat plate part on the side opposite to front surface panel 21 and extends from the left end to the right end of the first flat plate part, in addition to the above-described first flat plate part.

Eaves 23 has a shape that guides the airflow generated by fan F, toward air blow port 2*a*. Thus, the advancement of the air supplied toward outer surface 42 of outer sliding door 4 from the region on the side closer to closing end 41 of outer sliding door 4 in the fully closed state through air blow port 2*a* inside machine compartment MR of housing 2 is not prevented. Thus, the effect of preventing the generation of condensation at outer surface 42 of outer sliding door 4 can be further increased.

Since guiding hole 3*a* is formed in frame body 3, the condensation water of frame body 3, outer surface 42 of outer sliding door 4 and outer surface 52 of inner sliding door 5 can be guided into machine compartment MR of housing 2, and can be evaporated.

Next, a modification of the present disclosure is described.

Fan F may be provided at any location inside housing 2 as long as it can generate the airflow that passes through the periphery of compressor CP, and supply the air inside housing 2 to outer surface 42 of outer sliding door 4 and outer surface 52 of inner sliding door 5 through air blow port 2*a*. In addition, fan F need not necessarily be provided inside machine compartment MR of housing 2, and may be provided in the rear surface of outside housing 2, i.e., the intake port, for example.

Machine compartment MR need not necessarily be located on the lower side of refrigeration compartment R, and may be located on the upper side of refrigeration compartment R, for example. In this case, air blow port 2*a* is formed to face downward, and the airflow inside machine compartment MR of housing 2 goes out downward from air blow port 2*a* toward outer sliding door 4 and inner sliding door 5.

In addition, refrigerator 1 may include three or more sliding doors. In this case, compressor CP is disposed such that it is closer to the closing end of the innermost sliding door in the fully closed state than the closing end of the outermost sliding door in the fully closed state, assuming that the sliding door that is located on the most refrigeration compartment R side in the fully opened state is the innermost sliding door and that the sliding door that is remotest from refrigeration compartment R in the fully opened state is the outermost sliding door.

This application is a continuation of International Patent Application No. PCT/JP2020/030917, filed on Aug. 14, 2020, the disclosure of which is incorporated herein by reference in its entirety. International Patent Application No. PCT/JP2020/030917 is entitled to (or claims) the benefit of Japanese Patent Application No. 2019-155915, filed on Aug. 28, 2019, the disclosure of which is incorporated herein by reference in its entirety.

INDUSTRIAL APPLICABILITY

The refrigerator according to the present disclosure is suitable for refrigerators including a plurality of sliding doors. Therefore, its industrial applicability is very wide.

REFERENCE SIGNS LIST

1 Refrigerator
2 Housing
2*a* Air blow port
21 Front surface panel
22 Recorder attaching part
23 Eaves
3 Frame body

3*a* Guiding hole
31 Outer lane
32 Inner lane
4 Outer sliding door
4S Sliding door projection portion
41 Closing end
42 Outer surface
43 Inner surface
44 Handle
5 Inner sliding door
5S Sliding door projection portion
51 Closing end
52 Outer surface
53 Inner surface
54 Handle
R Refrigeration compartment
MR Machine compartment
CP Compressor
CD Condenser
F Fan
TB Pipe
RC Recorder

The invention claimed is:

1. A refrigerator comprising:

a first sliding door configured to open and close a refrigeration compartment;

a second sliding door configured to open and close the refrigeration compartment, the second sliding door being located between the refrigeration compartment and the first sliding door when the refrigeration compartment is in a fully opened state;

a compressor disposed at a position closer to a closing end of the second sliding door than a closing end of the first sliding door when the refrigeration compartment is in the fully closed state;

a fan configured to generate an airflow that passes through a periphery of the compressor;

a housing in which an air blow port is formed, the housing being configured to house the compressor, the air blow port being configured to blow out the airflow toward the first sliding door and the second sliding door;

a recorder attaching part disposed inside the housing at a position closer to the closing end of the first sliding door than the closing end of the second sliding door; and a recorder disposed on the recorder attaching part and configured to print a temperature inside the refrigeration compartment on a recording sheet and output the recording sheet to outside of the refrigerator, wherein the first sliding door and the second sliding door are located on a front surface side of the housing, wherein the housing includes a front surface panel configured to cover the inside from the front surface side, and wherein the recorder attaching part is located at a surface of the front surface panel on the inside, and on a lower side of the air blow port.

2. The refrigerator according to claim 1, further comprising an eaves located on a lower side of the refrigeration compartment, and configured to cover the recorder from an upper side.

3. The refrigerator according to claim 2, wherein the eaves has a shape that guides the airflow toward the air blow port.

4. The refrigerator according to claim 3, wherein the eaves further includes a first flat plate part and a second flat plate part, the first flat plate part being extended from a surface of the front surface panel on the inside, in a direction away from the front surface panel, the second flat plate part being extended from an end part of the first flat plate part on a side opposite to the front surface panel, in a direction downward of the eaves and a direction away from the front surface panel.

5. The refrigerator according to claim 4, wherein the eaves further includes a wall part protruded upward from the first flat plate part and extended from one end to another end of the first flat plate part in an opening closing direction of the first sliding door.

6. The refrigerator according to claim 2, wherein the eaves is configured to cover an entire range of an upper side of the recorder.

7. The refrigerator according to claim 1, further comprising a frame body in which a guiding hole configured to guide condensation water into the housing is formed, the frame body being configured to guide the first sliding door and the second sliding door.

8. A refrigerator comprising:

a first sliding door configured to open and close a refrigeration compartment;

a second sliding door configured to open and close the refrigeration compartment, the second sliding door being located between the refrigeration compartment and the first sliding door when the refrigeration compartment is in a fully opened state;

a compressor disposed at a position closer to a closing end of the second sliding door than a closing end of the first sliding door when the refrigeration compartment is in the fully closed state;

a fan configured to generate an airflow that passes through a periphery of the compressor;

a housing in which an air blow port is formed, the housing being configured to house the compressor, the air blow port being configured to blow out the airflow toward the first sliding door and the second sliding door;

a recorder attaching part disposed inside the housing at a position closer to the closing end of the first sliding door than the closing end of the second sliding door; and an eaves located on a lower side of the refrigeration compartment and over the recorder attaching part, wherein:

the first sliding door and the second sliding door are located on a front surface side of the housing, the housing includes a front surface panel configured to cover the inside from the front surface side, the recorder attaching part is located at a surface of the front surface panel on the inside, and on a lower side of the air blow port, the eaves has a shape that guides the airflow toward the air blow port, the eaves further includes a first flat plate part and a second flat plate part, the first flat plate part being extended from a surface of the front surface panel on the inside, in a direction away from the front surface panel, the second flat plate part being extended from an end part of the first flat plate part on a side opposite to the front surface panel, in a direction downward of the eaves and a direction away from the front surface panel, and the eaves further includes a wall part protruded upward from the first flat plate part and extended from one end to another end of the first flat plate part in an opening closing direction of the first sliding door.

* * * * *